US007036431B2

(12) United States Patent
Dunn et al.

(10) Patent No.: US 7,036,431 B2
(45) Date of Patent: May 2, 2006

(54) IDENTIFICATION DEVICES AND METHODS FOR PRODUCING THE IDENTIFICATION DEVICES

(75) Inventors: Matt Dunn, Norcross, GA (US); Mike Dunn, Norcross, GA (US); Jim Patton, Roswell, GA (US); James Thomas Keller, Sellersburg, IN (US)

(73) Assignee: JPatton Sports Marketing, Norcross, GA (US)

( * ) Notice: Subject to any disclaimer, the term of this patent is extended or adjusted under 35 U.S.C. 154(b) by 0 days.

(21) Appl. No.: 11/200,376

(22) Filed: Aug. 9, 2005

(65) Prior Publication Data

US 2005/0279237 A1 Dec. 22, 2005

Related U.S. Application Data

(62) Division of application No. 10/694,340, filed on Oct. 27, 2003, now Pat. No. 6,952,994.

(51) Int. Cl.
*B41F 33/00* (2006.01)

(52) U.S. Cl. ..... 101/483; 101/485; 101/23

(58) Field of Classification Search ..... 101/483–493, 101/23–28

See application file for complete search history.

(56) References Cited

U.S. PATENT DOCUMENTS

| | | | | |
|---|---|---|---|---|
| 4,563,024 | A | 1/1986 | Blyth | 283/91 |
| 4,933,120 | A | 6/1990 | D'Amato et al. | 264/13 |
| 5,003,915 | A | 4/1991 | D'Amato et al. | 118/46 |
| 5,342,672 | A | 8/1994 | Killey | 428/195 |
| 5,593,765 | A | 1/1997 | Sharpe et al. | 428/225 |
| 5,636,385 | A | 6/1997 | Harrison | 2/244 |
| 5,762,377 | A | 6/1998 | Chamberlain | 283/67 |
| 5,817,205 | A | 10/1998 | Kaule | 156/233 |
| 5,945,201 | A | 8/1999 | Holat | 428/192 |
| 5,951,182 | A | 9/1999 | Van Weverberg et al. | 400/708 |
| 5,981,040 | A | 11/1999 | Rich et al. | 428/209 |
| 6,036,810 | A | 3/2000 | Holat | 156/248 |
| 6,053,107 | A | 4/2000 | Hertel et al. | 101/409 |
| 6,120,882 | A | 9/2000 | Faykish et al. | 428/195 |
| 6,142,532 | A | 11/2000 | Gluck | 283/75 |
| 6,292,319 | B1 | 9/2001 | Thomas, III | 360/60 |

(Continued)

*Primary Examiner*—Minh Chau
(74) *Attorney, Agent, or Firm*—Thomas, Kayden, Horstemeyer, & Risley

(57) ABSTRACT

Identification devices and methods of producing the identification devices are presented. Some embodiments of identification devices comprise a structure having a micro-optic image and a layer that is overprinted onto the surface of the structure. In some embodiments, the structure is a substantially planar structure, such as a cardstock sheet, and the micro-optic image is a hologram. A web-fed flexographic printing process is presented, in which the process comprises the steps of providing a web, determining a feed rate for the web, feeding the web at the determined feed rate, and overprinting onto a surface of the web. In some embodiments, the web has a micro-optic structure and an eye-mark. The micro-optic structure is located at a predefined position on the web, and the eye-mark is located at a fixed position with reference to the position of the micro-optic structure. The feed rate is determined using the eye-mark. In some embodiments, the micro-optic structure is a hologram.

2 Claims, 10 Drawing Sheets

U.S. PATENT DOCUMENTS 6,432,498 B1 8/2002 Ohtaki et al. ..... 428/40.1
6,454,895 B1 9/2002 Weder ..... 156/209
6,482,489 B1 11/2002 Otaki et al. ..... 428/40.1
6,506,315 B1 1/2003 Ferro ..... 216/100
6,531,024 B1 * 3/2003 Braun ..... 156/277
6,578,505 B1 6/2003 Berzack ..... 112/475.15
6,694,872 B1 * 2/2004 LaBelle et al. ..... 101/23
2002/0130104 A1 9/2002 Lieberman et al. ..... 216/35

* cited by examiner

IDENTIFICATION DEVICES AND METHODS FOR PRODUCING THE IDENTIFICATION DEVICES

CROSS-REFERENCE TO RELATED APPLICATION

This application is a divisional of U.S. patent application Ser. No. 10/694,340, filed Oct. 27, 2003 now U.S. Pat. No. 6,952,994.

FIELD OF THE INVENTION

The present invention relates generally to identification devices and, more particularly, to hang-tags, security cards, labels, tickets, and/or other devices that may be used to identify merchandise, and methods for producing the identification devices.

BACKGROUND

Identification devices, such as hang-tags, are widely used to identify merchandise by various manufacturers. For example, when a major sports team or organization endorses a particular item, the endorsement of that item by the sports team or organization is often provided on hang-tags that are attached to the item. Since these hang-tags carry the insignia of the endorsing organization, these hang-tags often include security features. The security features are used to authenticate merchandise and deter unauthorized duplication of the merchandise. One example of a security feature is a hologram, which provides a feature that is easily distinguishable by the naked eye but difficult to duplicate without relatively great expense.

Conventionally, for hang-tags employing holograms, a thin holographic layer is hot stamped onto a cardstock material, which is later cut into hang-tags. Unfortunately, the hot stamping process results in a degradation of the hologram due to the flattening of various holographic features.

As an alternative, rather than hot stamping a hologram onto a hang-tag, a holographic layer is secured to the cardstock using an adhesive. For example, a holographic "tape" is applied to the cardstock in long strips, and the cardstock is thereafter cut into individual hang-tags. Unfortunately, the process employing holographic tapes is relatively costly, cumbersome, and inefficient.

In view of the deficiencies that accompany such conventional methods, a heretofore unaddressed need exists in the industry.

SUMMARY

The present disclosure provides for identification devices and methods of producing the identification devices.

Briefly described, in architecture, some embodiments of identification devices comprise a structure having a micro-optic image and a layer that is overprinted onto the surface of the structure. In some embodiments, the structure is a substantially planar structure, such as a cardstock sheet, and the micro-optic image is a hologram.

The present disclosure also provides methods for fabricating identification devices.

In this regard, one embodiment of the method is a web-fed flexographic printing process that comprises the steps of providing a web, determining a feed rate for the web, feeding the web at the determined feed rate, and overprinting onto a surface of the web. In some embodiments, the web has a micro-optic structure and an eye-mark. The micro-optic structure is located at a predefined position on the web, and the eye-mark is located at a fixed position on the web with reference to the position of the micro-optic structure. The feed rate is determined using the eye-mark. In some embodiments, the micro-optic structure is a hologram.

Other systems, devices, methods, features, and advantages will be or become apparent to one with skill in the art upon examination of the following drawings and detailed description. It is intended that all such additional systems, devices, methods, features, and advantages be included within this description, be within the scope of the present invention, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION OF THE EMBODIMENTS

Figure 1:
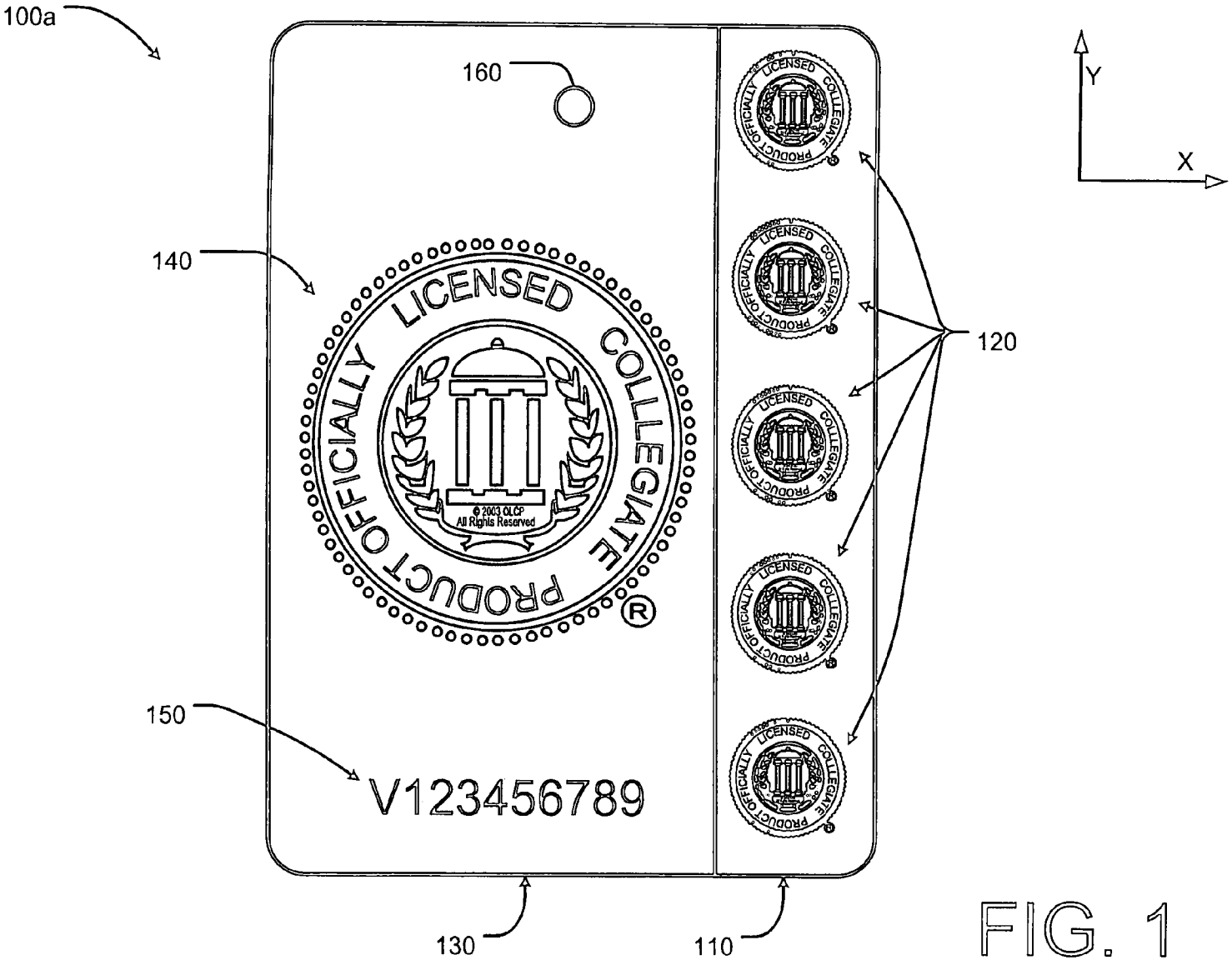
FIG. 1 is a diagram showing a front view of a hang-tag comprising a holographic sheet and a layer overprinted onto a portion of the holographic sheet.

Reference is now made to the detailed description of the embodiments as illustrated in the drawings. While several embodiments are described in connection with these drawings, there is no intent to limit the invention to the embodiment or embodiments disclosed herein. On the contrary, the intent is to cover all alternatives, modifications, and equivalents.

Identification devices, such as hang-tags, are widely used to identify merchandise by various manufacturers. These hang-tags often employ security features, such as holograms, which provide easily-distinguishable but difficult-to-duplicate features. Hence, the security features deter unauthorized duplication of the hang-tags.

Unfortunately, for conventional approaches to fabricating hang-tags with holograms, degradation of the holograms often results from flattening of various holographic features. Alternative processes, such as employing holographic tapes, are relatively costly, cumbersome, and inefficient. Similarly, sheet-fed lithographic processes, which permit registered overprinting onto holographic sheets, are also inefficient as compared to web-fed flexographic printing processes.

The following disclosure provides several embodiments of systems and methods for generating hang-tags with holographic or other security features. Several embodiments employ web-fed flexographic processes to generate hang-tags, thereby eliminating inefficiencies associated with sheet-fed lithographic printing processes.

In some embodiments, eye-marks are provided on a web to permit registered overprinting of a layer onto a holographic sheet during a web-fed flexographic printing process. In an example embodiment, a sensor is provided in a web-fed flexographic printing system. The sensor detects the location of the eye-mark and provides a signal to a controller. The controller adjusts the feed rate of the web, thereby controlling the location of the overprinted layer. Hence, if the eye-mark is located at a fixed position with reference to a particular holographic feature, then the layer is overprinted at a registered location with reference to the holographic feature. The resulting overprinted web may be die cut into various shapes to generate identification devices, such as bang-tags, identification cards, labels, tickets, etc.

Figure 6:
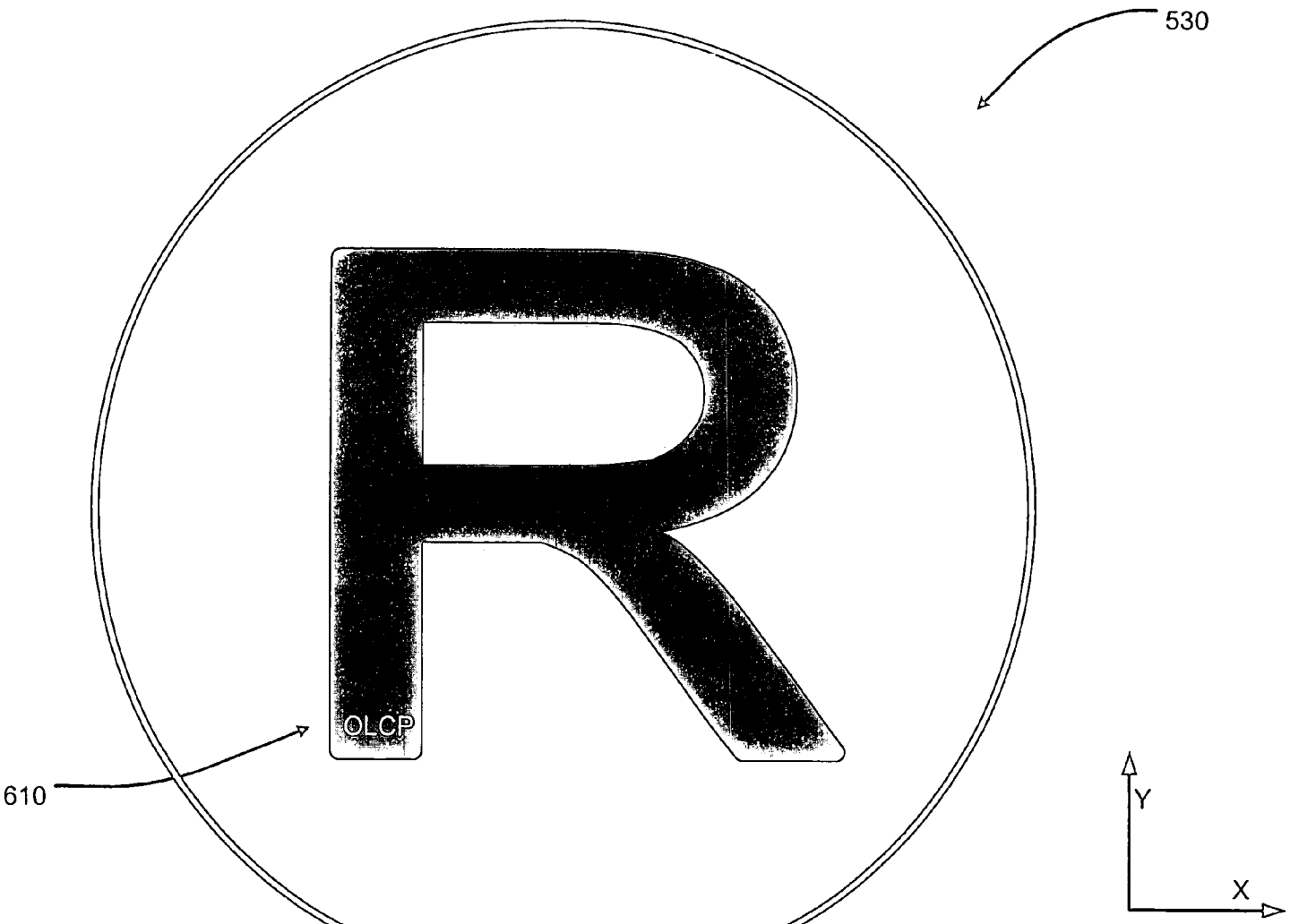
FIG. 6 is a diagram showing, in greater detail, one security feature of FIG. 5.
Figure 7:
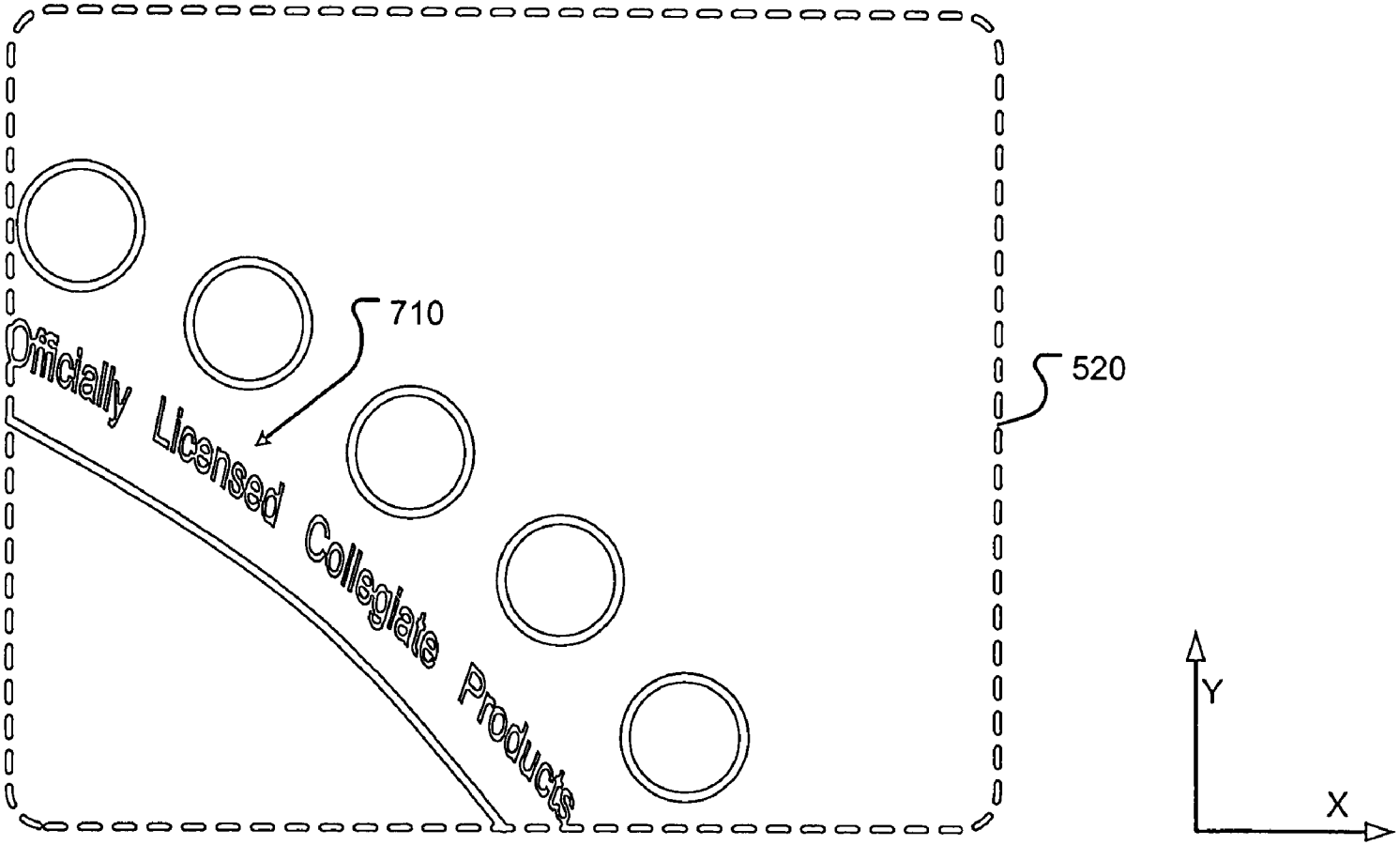
FIG. 7 is a diagram showing, in greater detail, another security feature of FIG. 5.
Figure 8:
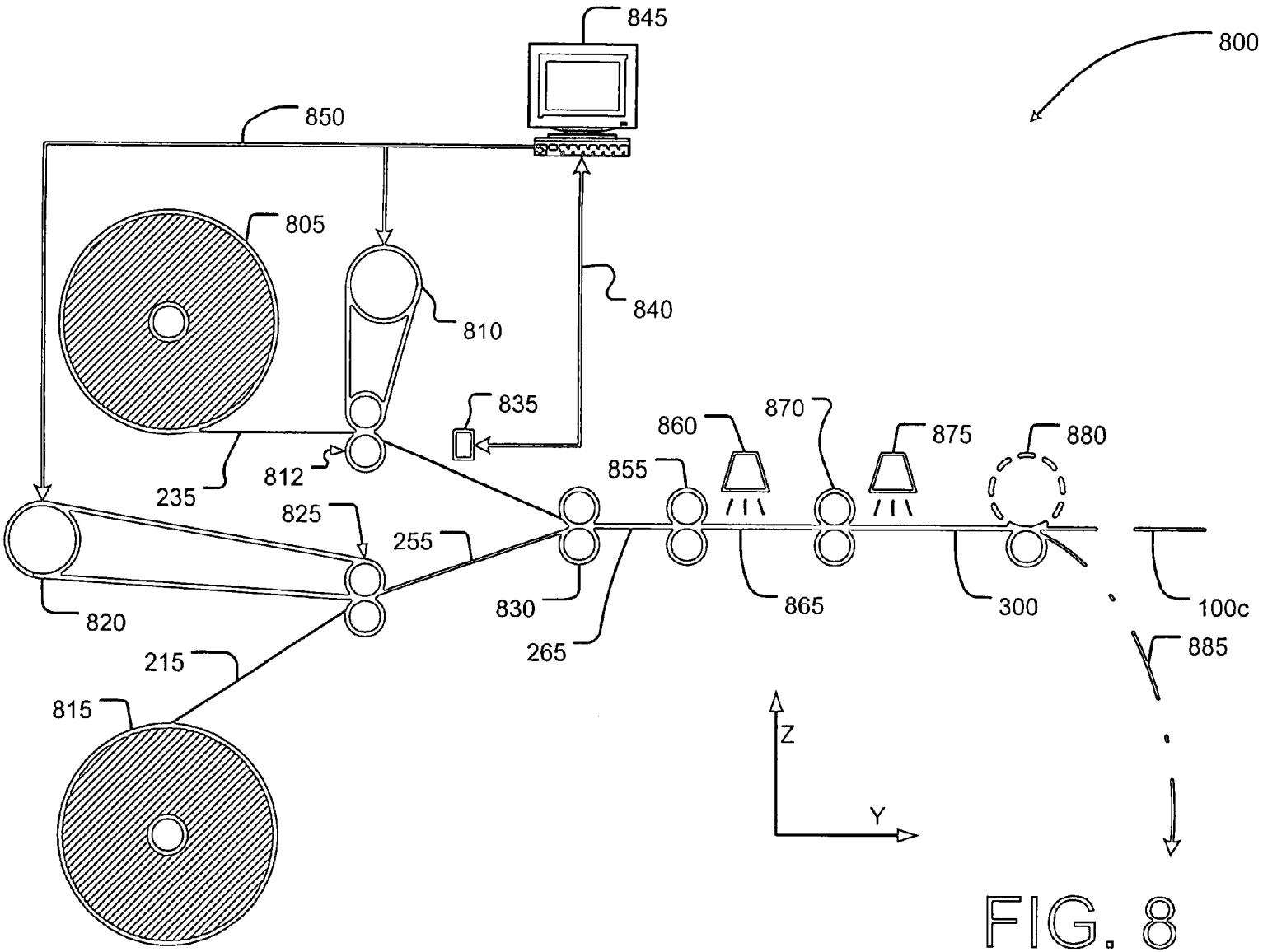
FIG. 8 is a diagram showing a web-fed flexographic printing system configured for registered overprinting onto a web.
Figure 9:
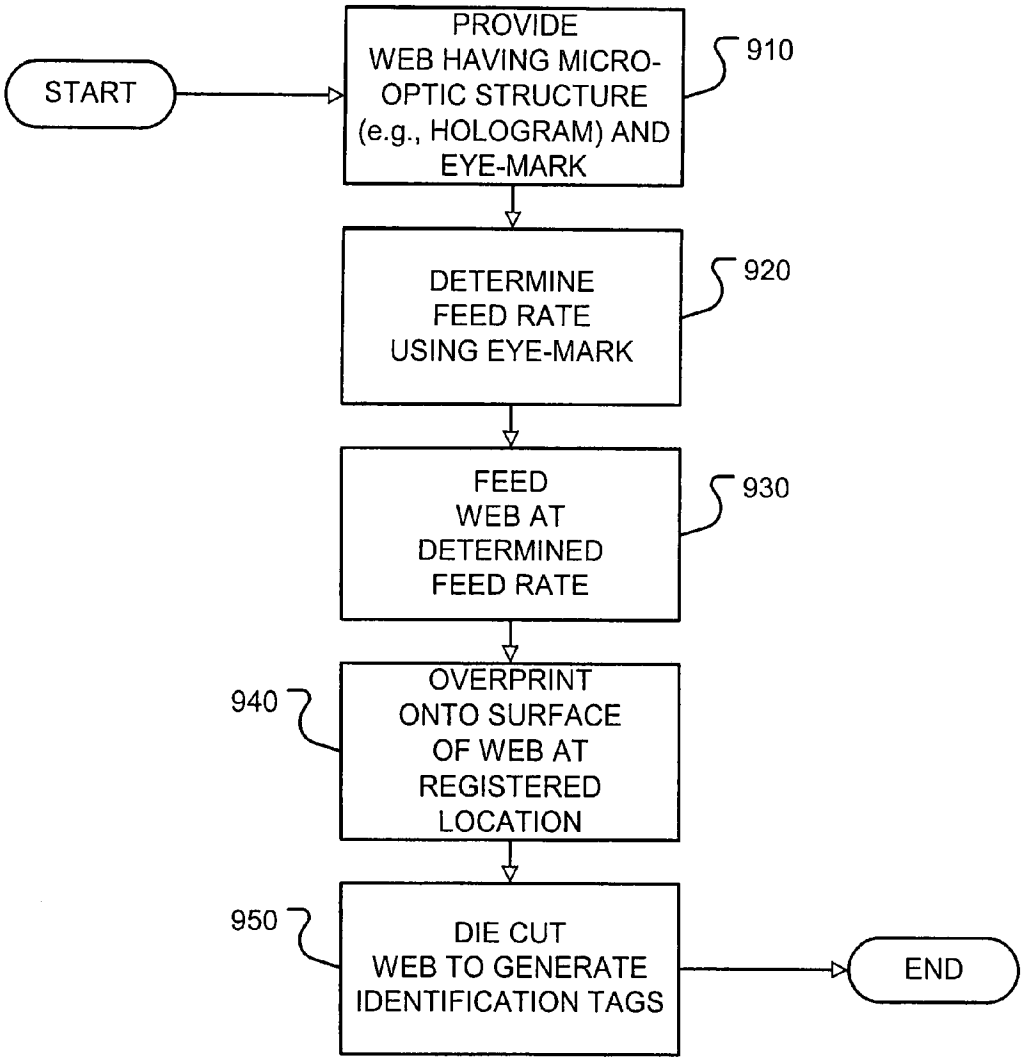
FIG. 9 is a flowchart showing an embodiment of a process for registered overprinting.
Figure 10:
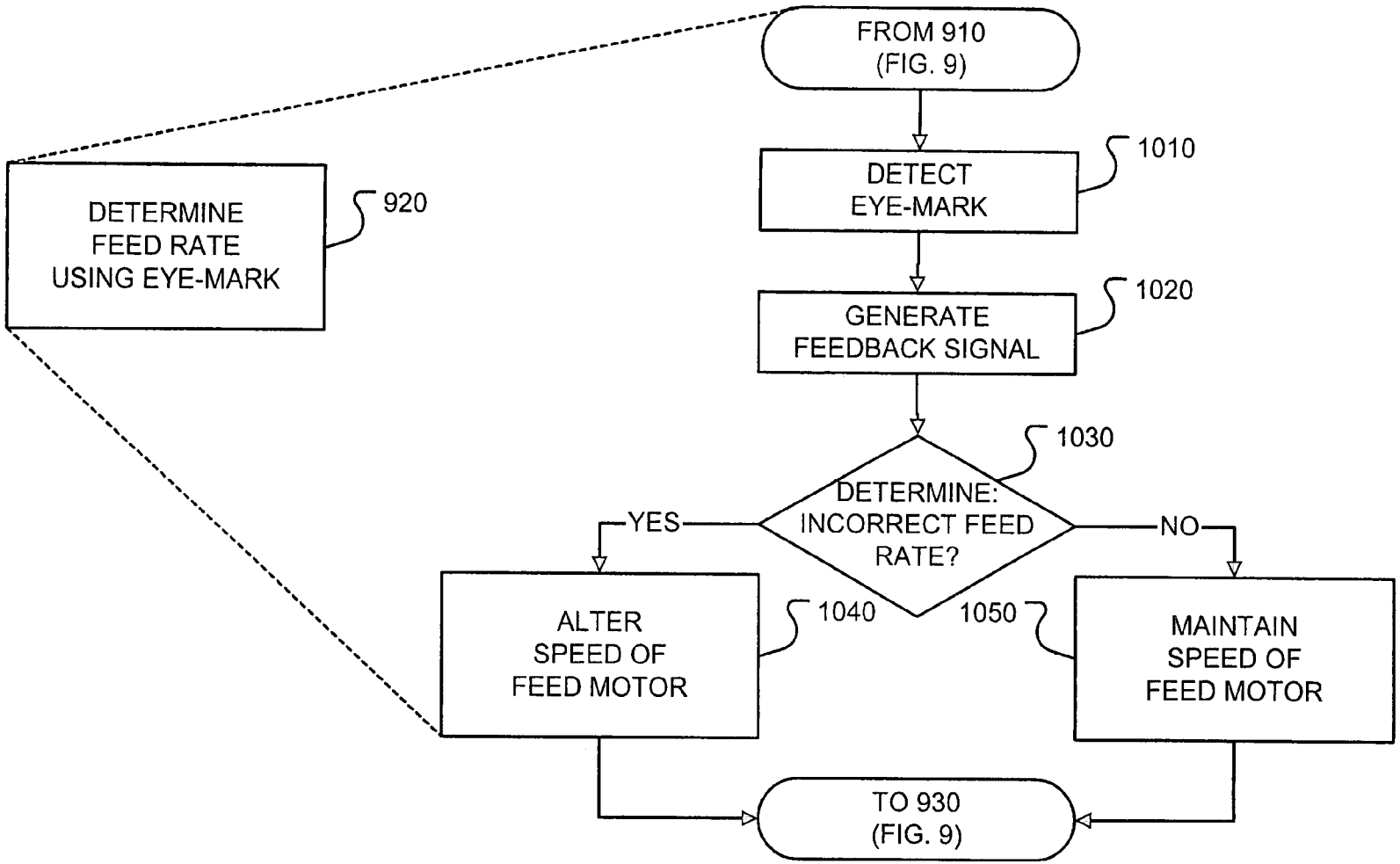
FIG. 10 is a flowchart showing, in greater detail, the feed-rate-adjusting step of FIG. 9.

FIGS. 1 through 7 show various embodiments of identification devices (e.g., hang-tags 100, etc.). FIG. 8 shows an embodiment of a web-fed flexographic printing system 800, which employs a feedback signal 840 to control the location of an overprinted layer 240. FIGS. 9 through 10 provide embodiments of processes for generating identification devices.

Figure 2:
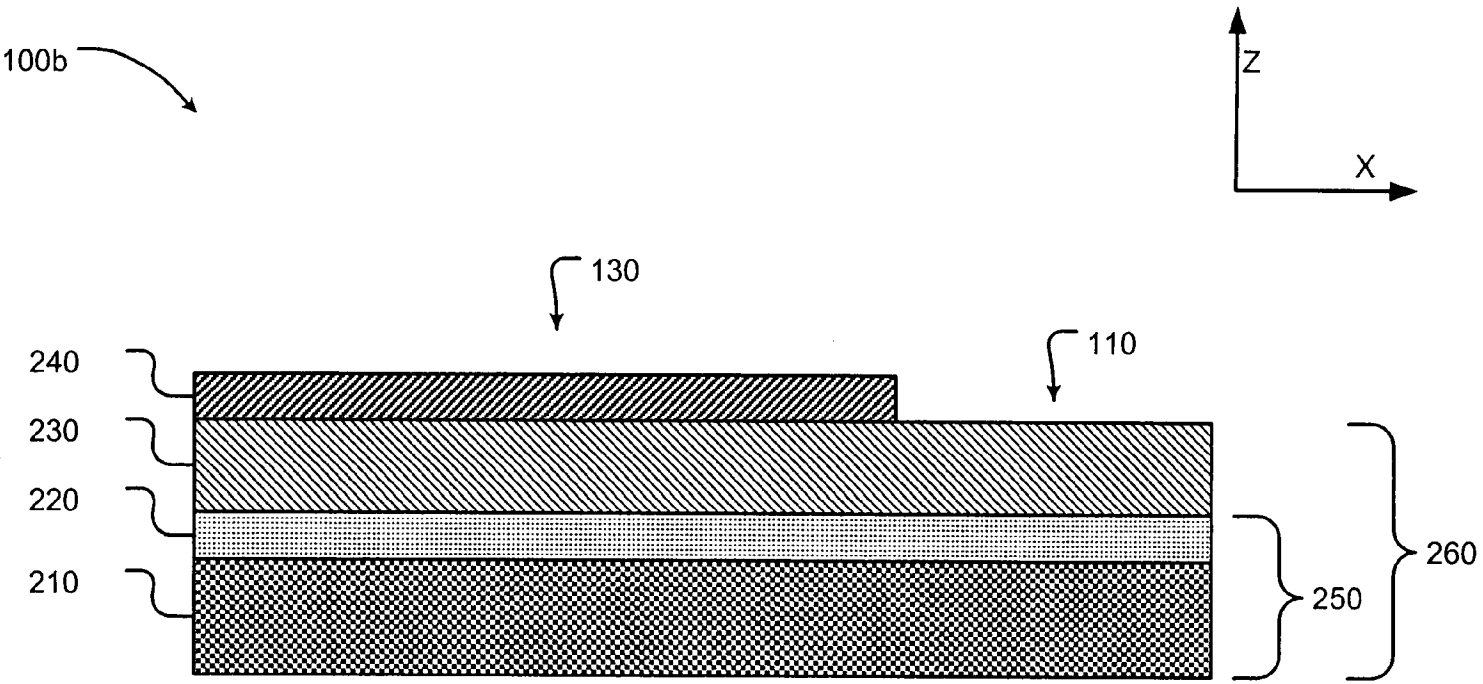
FIG. 2 is a diagram showing a side view of the hang-tag of FIG. 1.

FIG. 1 is a diagram showing a front view of a hang-tag 100*a* comprising a holographic sheet 230 (FIG. 2) and an overprinted layer 240 (FIG. 2) on a portion 130 of the holographic sheet 230 (FIG. 2). The hang-tag 100*a* represents a non-limiting example of an identification device. As shown in FIG. 1, the hang-tag 100*a* has an exposed portion 110 that partly shows the holographic sheet 230 (FIG. 2), an overprinted portion 130, and a hole 160 for tying the hang-tag 100*a* to merchandise or apparel (not shown).

The overprinted portion 130 includes a predefined pattern 140, which may represent a mark of a company, a sports team, an agency, etc. In other words, the predefined pattern 140 may be indicative of endorsement by a particular company, sports team, or agency. The overprinted portion 130 also includes a serial number 150, which may identify a product as being unique.

The exposed portion 110 includes holograms 120. In the embodiment of FIG. 1, the holograms 120 have a pattern similar to the predefined pattern 140 on the overprinted portion 130, thereby further reinforcing the endorsement by the owner of the mark. While holograms 120 are shown in FIG. 1 to illustrate an example identification device, it should be appreciated that other micro-optic structures (e.g., those produced by Nanoventions of Roswell, Ga.) may be used instead of holograms 120 or in conjunction with holograms 120.

FIG. 2 is a diagram showing a side view of the hang-tag 100*b* of FIG. 1. As shown in FIG. 2, the hang-tag 100*b* comprises a substrate 210 that is married to a holographic sheet 230 by an adhesive layer 220. The substrate 210 may comprise a cardstock material, a flexible plastic material, or any other material that is amenable to a web-fed flexographic printing process. For simplicity, the combination of the substrate 210 and the holographic sheet 230 is also referred to herein as a married web 260. The holographic sheet 230 defines a substantially planar surface, which is amenable to overprinting. As shown in FIG. 2, a portion 130 of the holographic sheet 230 has been overprinted with an overprinted layer 240. Thus, a portion 110 of the holographic sheet 230 is left exposed after the application of the overprinted layer 240. In some embodiments, the overprinted layer 240 is an ultraviolet (UV)-curable ink. Example UV-curable inks may include mixtures of polyester, epoxy, urethane, acrylic oligomers, functional monomers, and proprietary blends of various photoinitiators. Specific examples of UV-curable inks are Pureflex RLL and RLN inks, which are available from Water Ink Technologies, Inc., in Lincolnton, N.C. Since UV-curable inks are known by those skilled in the art, further discussion of UV-curable inks is omitted here.

Figure 3:
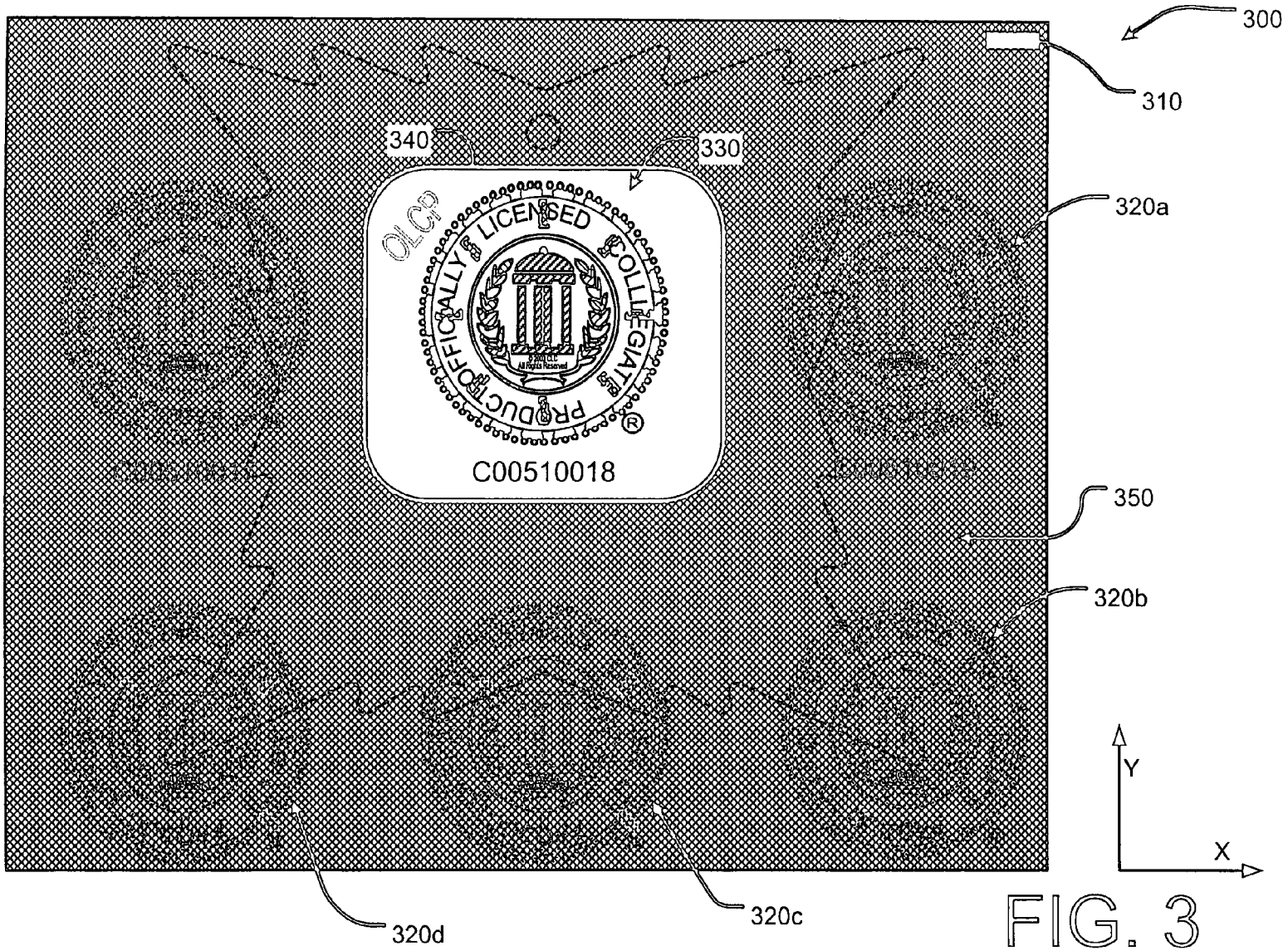
FIG. 3 is a diagram showing a front view of a portion of a web with a registered overprinted layer.

FIG. 3 is a diagram showing a front view of a portion of a web with a registered overprinted layer 350. For simplicity, the web with the registered overprinted layer 350 is also referred to herein as a registered overprinted web 300. As shown in FIG. 3, some embodiments of the registered overprinted web 300 comprise an opening 340 (or a window), which exposes an underlying hologram 330 that is located at a predefined location. The registered overprinted web 300 also includes an eye-mark 310. In some embodiments, the eye-mark is located at a fixed position on the web. For example, the eye-mark may be located adjacent to every third hologram along the Y-axis. Alternatively, the eye-mark may be located between each hologram along the Y-axis. It should be appreciated that the distance between eye-marks may be defined according to the feed rate of the web and the desired precision of the overprinted location.

The eye-mark 310 is registered with the hologram 330 such that the hologram 330 and the eye-mark 310 are located at fixed positions relative to each other. Thus, if the location of the eye-mark 310 is determined, then the predefined location of the hologram 330 may be determined from the location of the eye-mark 310. The embodiment of FIG. 3 shows the opening 340 and the underlying hologram 330 being registered to each other.

As shown in FIG. 3, if the registered overprinted layer 350 is a semi-transparent ink, then other underlying holograms may appear through the semi-transparent ink as ghosts 320. In this regard, the registered overprinted layer 350 itself may be a security feature. For example, unlike registered overprinting with semi-transparent inks, conventional methods, such as application of holographic tape, do not provide ghosts 320 that may be used to identify sponsorship or endorsement. Additionally, if the registered overprinted layer 350 is opaque, then a portion of that layer may be removed (e.g., scratched) to reveal the underlying holograms. In this regard, the overprinting approach provides a security feature that may not be available using conventional techniques for fabricating hang-tags.

Figure 5:
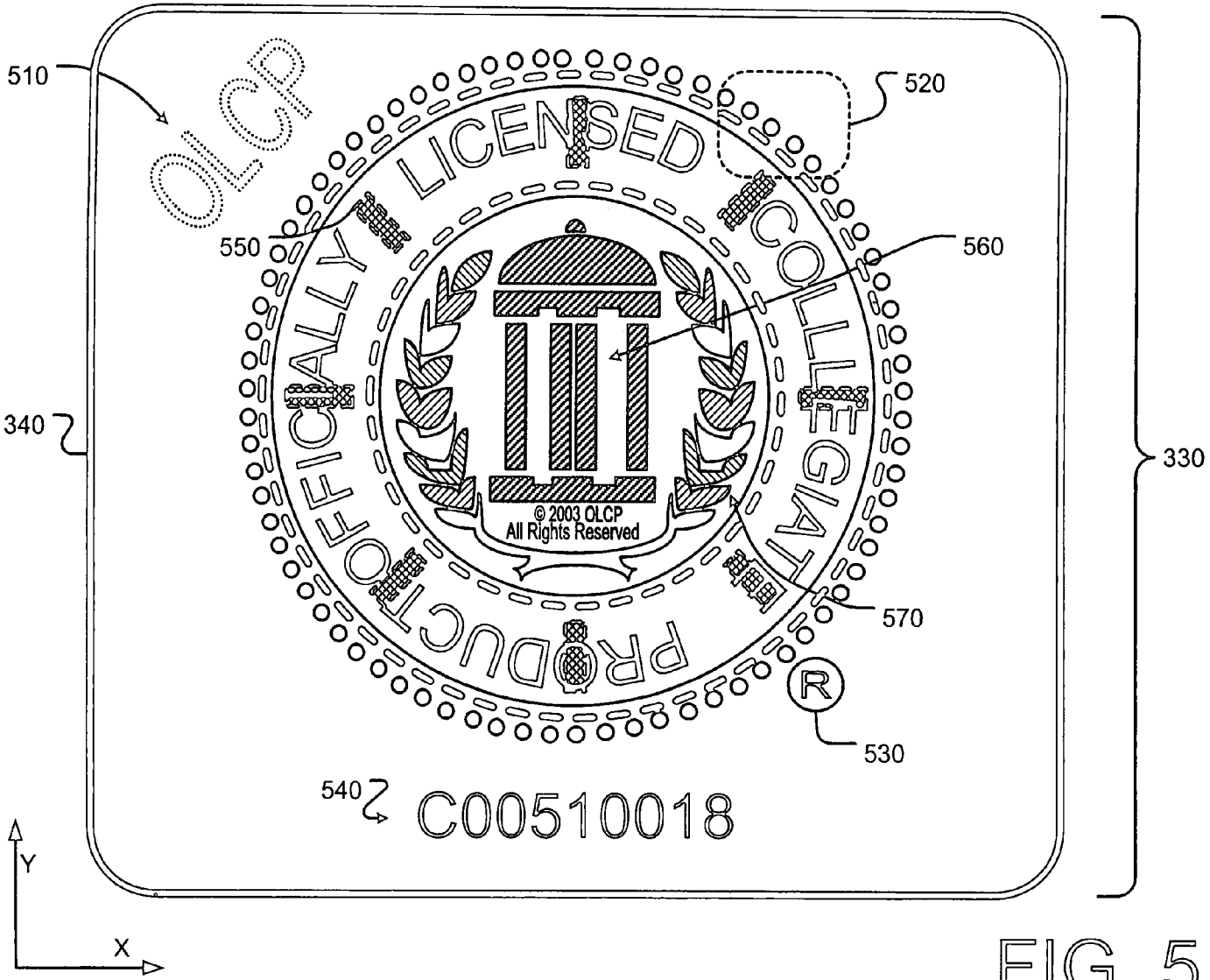
FIG. 5 is a diagram showing, in greater detail, security features embedded in the hologram of FIGS. 3 and 4.

The registered overprinting process provides a mechanism by which a larger hologram may be used. By employing larger holograms, additional security features may be embedded into the holographic sheet, thereby further deterring unauthorized duplication. Examples of additional security features are shown in FIG. 5.

It should be appreciated that, although FIG. 3 shows the eye-mark 310 being located on the front of the web, the eye-mark 310 may instead be located on the back of the web, as long as the eye-mark 310 and the hologram 330 are registered with each other.

Figure 4:
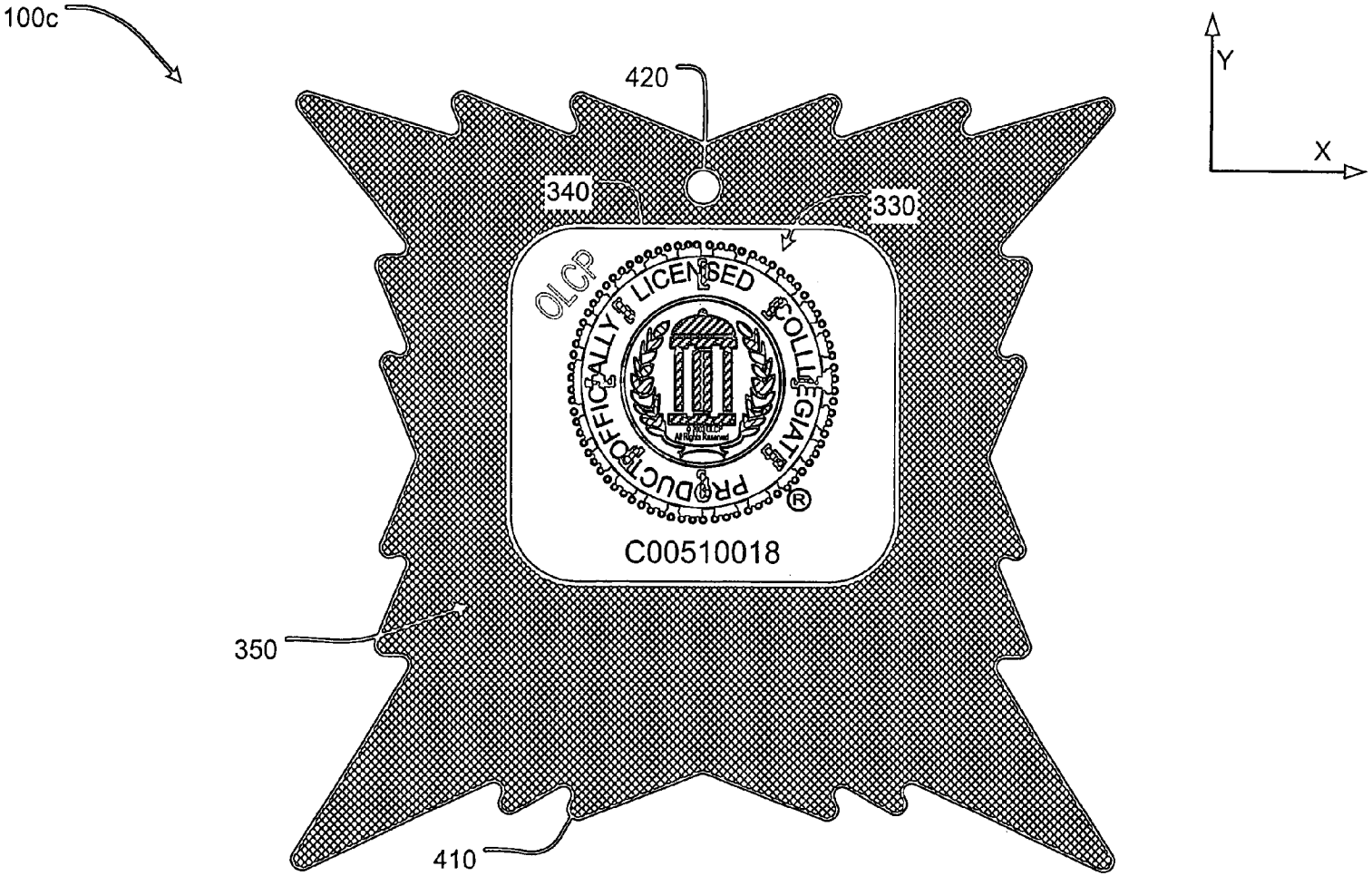
FIG. 4 is a diagram showing an identification device having a hologram, which is produced from the registered overprinted web of FIG. 3.

FIG. 4 is a diagram showing a hang-tag 100*c* having a hologram 330, which is produced from the registered overprinted web 300 of FIG. 3. As shown in FIG. 4, the hang-tag 100*c* can be a structure having any shape 410. In other words, unlike conventional hang-tags that are substantially rectangular, the hang-tags 100*c* produced from the web-fed flexographic printing process may be die-cut into any shape, including non-rectangular geometric shapes. A hole 420 may also be die-cut into the hang-tag 100*c* to permit attachment of the hang-tag 100*c* to merchandise or apparel.

The hang-tag 100*c* shows the underlying hologram 330 exposed by the opening 340. Thus, as shown in FIG. 4, the overprinted layer 350 is registered with the hologram 330 such that the opening 340 is also registered with the hologram 330. In other words, the opening 340 and the hologram 330 are fixed, both vertically (Y-axis) and horizontally (X-axis), with reference to each other. Additionally, it should be appreciated that the shape of the opening 340 may be customized to substantially correspond to the shape of the hologram 330.

FIG. 5 is a diagram showing, in greater detail, security features embedded in the hologram 330 of FIGS. 3 and 4. As shown in FIG. 5, some embodiments of the hologram 330 include security features such as, for example, a laser projection marking 510, a microprint portion 520 (shown in greater detail with microprint 710 in FIG. 7), a nanoprint portion 530 (shown in greater detail with nanoprint 610 in FIG. 6), a unique serial number 540, a disappearing holographic image 550, a three-dimensional (3-D) stereogram 560 (also referred to herein as a 3-D stereographic hologram), and a view-angle-dependent holographic image 570.

The serial number 540 uniquely identifies items associated with the hang-tag 100*c* (FIG. 4). In this regard, the unique serial numbers 540 are often sequential. The unique serial numbers 540 may be associated with a particular lot and manufacturing facility. Thus, for items attached to the hang-tag 100*c*, the source of that item may be determined using the unique serial number 540. Since a variety of uses for unique serial numbers 540, and methods for sequentially printing serial numbers, are known to those skilled in the art, further discussion of serial numbers 540 is omitted here.

Both the disappearing holographic image 550 and the view-angle-dependent holographic image 570 are shown as features in the hologram 330 of FIG. 5. The disappearing holographic image 550 is configured to selectively appear and disappear when viewed from different angles. Similarly, the view-angle-dependent holographic image 570 is configured to change colors or brightness when viewed from different angles. Specifically, the disappearing holographic image 550 of FIG. 5 is implemented as a collection of pillars that are interspersed within the text "Officially Licensed Collegiate Product." However, it should be appreciated that other images or text may used to implement the disappearing holographic image 550.

The view-angle-dependent holographic image 570 of FIG. 5 is implemented as an image of a wreath. However, it should be appreciated that the view-angle-dependent holographic image 570 may also be implemented with different images or text. Since processes for fabricating the disappearing holographic image 550 and the view-angle-dependent holographic image 570 are known in the art, further discussion of such processes is omitted here.

The 3-D stereogram 560 is configured to provide depth to an object represented by the 3-D stereogram 560. In this regard, when the 3-D stereogram 560 is viewed from different angles, the observer sees different facets of the object. Specifically, the 3-D stereogram 560 of FIG. 5 is implemented as a 3-D gazebo. In this regard, when the observer views the 3-D stereogram 560 from different angles, different sides of the gazebo appear to the observer. Stated differently, the gazebo will "rotate" when the observer views the 3-D stereogram 560 from different angles. As is known to those having skill in the art, 3-D stereograms may be fabricated using electron beam lithographic processes. Since electron beam lithographic processes are known in the art, further discussion of electron beam lithographic processes is omitted here.

The laser projection marking 510, the microprint 710 (FIG. 7), and the nanoprint 610 (FIG. 6) may be undetectable to the naked eye. The laser projection marking 510 may be configured to project a predefined image when the laser projection marking 510 is irradiated with a laser beam. Specifically, in FIG. 5, the laser projection marking 510 is configured to project the text OLCP when irradiated with a laser beam. Since laser projection markings, and methods for fabricating such markings, are known to those skilled in the art, further discussion of laser projection markings 510 is omitted here.

While both the microprint 710 (FIG. 7) and the nanoprint 610 (FIG. 6) are undetectable to the naked eye, both of these security features may be observed at various levels of magnification. FIG. 6 is a diagram showing, in greater detail, one embodiment of the nanoprint portion 530 of FIG. 5. As shown in FIG. 6, a nanoprint 610 is embedded in the ® symbol. Specifically, FIG. 6 shows a 25-μm text OLCP embedded in the vertical leg of the letter "R" in the ® symbol. The nanoprint 610 text may be fabricated using techniques such as, for example, electron beam lithography, which permit the fabrication of discernable text as small as, or smaller than, approximately 20 μm. FIG. 7 is a diagram showing, in greater detail, one embodiment of the microprint portion 520 of FIG. 5. Specifically, FIG. 7 shows microprint 710 text that reads "Officially Licensed Collegiate Products." Typically, microprint 710 text ranges from between approximately 100 μm and approximately 200 μm. In the embodiment of FIG. 7, the microprint 710 text is between approximately 120 μm and approximately 170 μm.

While various security features are shown as either an image or text, it should be appreciated that the security features may be implemented as either an image, or a text, or a combination of both an image and text. For example, while the disappearing holographic image 550 of FIG. 5 is an image of a pillar, it should be appreciated that the disappearing holographic image 550 may be implemented as disappearing text. Similarly, while the laser projection marking 510 specifically shows the text OLCP, it should be appreciated that the laser projection marking 510 may be a projectable image, rather than projectable text. Similarly, it should be appreciated that the laser projection marking 510 may be a combination of both an image and text.

Also, while a certain combination of security features are shown in FIGS. 5 through 7, it should be appreciated that each of these security features may be used alone or in conjunction with other security features. In this regard, a variety of permutations are possible to achieve different levels of security for a given hang-tag configuration. Similarly, while only a limited number of security features are shown in FIGS. 5 through 7, it should be appreciated that other security features, which are relatively difficult to replicate, may be used in conjunction with, or instead of, the security features shown in FIGS. 5 through 7.

FIG. 8 is a diagram showing a web-fed flexographic printing system 800 configured for registered overprinting onto a web. As shown in FIG. 8, an embodiment of the system comprises a first roller 805 that supplies a holographic sheet 235 to subsequent rollers and stations in the web-fed flexographic printing system 800. In the embodiment of FIG. 8, the holographic sheet 235 includes eye-marks that are positioned at various locations on the holographic sheet. Typically, the holographic sheet 235 includes one or more security features, as described above. As shown in FIG. 8, the first roller 805 is a static roller that is coupled to a driver roller 812 by the holographic sheet 235. The drive roller 812 is often driven by a motor 810. As described above, the location of the eye-marks are set to correspond with the location of various holographic features (or other security features) on the holographic sheet 235.

The embodiment of FIG. 8 also includes a second roller 815 that supplies a substantially-planar substrate 215, such as, for example, a cardstock substrate or other flexible material that is amenable to web-fed flexographic printing processes. In the embodiment of FIG. 8, the substrate 215 may be blank or may include pre-printed material. In some embodiments, the pre-printed material may also include an eye-mark.

Similar to the first roller 805, the second roller 815 is also driven by a motor 820. The substrate 215 is fed through a set of adhesive rollers 825, which apply an adhesive to one side of the substrate 215. Thus, upon application of the adhesive, the substrate 215 emerges from the adhesive rollers 825 as an adherable (or "sticky") substrate 255. Both the holographic sheet 235 and the sticky substrate 255 are fed through a glue station 830. The glue station 830 marries the holographic sheet 235 to the adhesive side of the sticky substrate 255, thereby producing a married web 265.

The married web 265 is fed into a first ink station 855, which applies a first ink or dye to the holographic side of the married web 265. For example, the first ink station 855 may apply a white ink to holographic side of the married web 265. Thus, in this example, the application of the first ink produces a web 865 with white overprinting. The white overprinted web 865 passes through an ultraviolet (UV) curing station 860 that cures the applied ink.

As shown in the embodiment of FIG. 8, the white overprinted web 865 may be further fed through another ink station 870 and another curing station 875 in order to apply a different color overprint. While only two ink stations 855, 870 and two curing stations 860, 875 are shown in FIG. 8, it should be appreciated that the number of ink stations and curing stations may be varied depending on the final overprint design. Since such variations should be appreciated by those having skill in the art, further discussion of ink stations and curing stations is omitted here.

The embodiment shown in FIG. 8 also includes a sensor 835 coupled to a controller 845. The sensor 835 is located after the glue station 830, and is configured to detect the eye-mark as the married web 265 emerges from the glue-station 830. Upon detecting the eye-mark, the sensor 835 is configured to generate a feedback signal 840, which is fed into the controller 845. Upon receiving the feedback signal 840, the controller 845 determines the position of the eye-mark. The position of the eye-mark is used to further determine the location of the overprint. If the controller 845 determines that the location of the overprint will be too far along the married web (i.e., the location of the overprint is too far in the +Y direction), then the controller 845 generates a control signal 850 to increase the feed rate of the motors 810, 820. Conversely, if the controller 845 determines that the location of the overprint is not far enough on the married web (i.e., the location of the overprint is too far in the −Y direction), then the controller 845 generates a control signal 850 to decrease the feed rate of the motors 810, 820.

In this regard, the controller 845 receives the feedback signal 840 from the sensor 835 and generates a control signal 850 that appropriately adjusts the rate of the motors 810, 820. The adjustment of the motors 810, 820 results in an adjustment of the feed rate, which, in turn, results in a shifting of the overprint location. Thus, the registered overprinted web 300 that emerges from the ink stations 855, 870 and the curing stations 860, 875 will have an overprinted layer that is registered with a particular feature on the holographic sheet 235. For example, the registered overprinted web 300 may appear similar to that shown in FIG. 3. Since feedback systems are known to those having skill in the art, further discussion of feedback systems is omitted here. However, it should be appreciated that, by adding a sensor 835 and a controller 845 to the web-fed flexographic printing system 800, the overprint location of the may be controlled.

The registered overprinted layer 300 is directed through a rotary die 880, which cuts the registered overprinted layer 300 into various hang-tags 100*c* and expels the residual web material 885. An example hang-tag is shown with reference to FIG. 4. Since a rotary die 880 is used to cut the registered overprinted layer 300, the resulting hang-tags 100*c* need not be rectangular in shape. In fact, the shape of the resulting hang-tags 100*c* may be varied by concomitantly varying the die pattern on the rotary die 880. Thus, unlike sheet-fed lithographic printing processes, which are not easily amenable to cutting into various shapes, the web-fed flexographic process permits greater flexibility in generating hang-tags 100*c* of various geometric shapes.

Having described several embodiments of identification devices and several embodiments of systems for generating identification devices, attention is turned to FIGS. 9 and 10, which show embodiments of methods for generating identification devices.

FIG. 9 is a flowchart showing an embodiment of a process for registered overprinting. As shown in FIG. 9, an embodiment of the process begins by providing (910) a web having a micro-optic structure (e.g., hologram) and an eye-mark. The web may be provided (910) on rollers that are coupled to feed motors that control the rate at which the web is fed through a web-fed flexographic printing system. As described above, the micro-optic structure is located at a predefined location on the web, and the eye-mark is located at a fixed location with reference to the location of the micro-optic structure. In other words, the eye-mark and the micro-optic structure are registered to each other. The embodiment of FIG. 9 further comprises the step of determining (920) a feed rate of the web. The feed rate is determined (920) using the eye-mark. The step of determining (920) the feed rate is shown in greater detail with reference to FIG. 10. Once the proper feed rate has been determined (920), the web is fed (930) through the system at the determined feed rate. As the web is fed (930) through at the determined feed rate, one or more layers are overprinted (940) onto the surface of the web. Since the feed rate is determined as a function of the location of the eye-mark, the location of the overprinted layer is registered to the location of the eye-mark. Furthermore, since the location of the eye-mark and the location of the micro-optic structure are registered to each other, the location of the overprinted layer is further registered with the location of the micro-optic structure. Upon registered overprinting onto the web, the web material is die cut (950) to generate identification tags, such as, for example, hang-tags, labels, tickets, cards, etc.

FIG. 10 is a flowchart showing, in greater detail, the feed-rate-adjusting step of FIG. 9. As shown in FIG. 10, in some embodiments, the feed-rate-determining step (920) begins by detecting (1010) the eye-mark. In response to detecting (1010) the eye-mark, a feedback signal is generated (1020). From the feedback signal, the system determines (1030) whether or not the feed rate should be adjusted. In other words, the system determines (1030) whether the feed rate is too fast or too slow. If the system determines (1030) that the feed rate is incorrect, then the speed for the feed motors is altered appropriately. If, however, the system determines (1030) that the feed rate is correct, then the speed of the feed motors is maintained (1050) (i.e., not altered). The feed rate may be altered in a manner similar to that described with reference to FIG. 8.

As shown in FIGS. 9 and 10, the eye-mark is used in conjunction with a feedback controller to adjust the speed of the feed motors. The feed rate of the web is adjusted by adjusting the speed of the feed motors. Consequently, the position of the overprinted layer is adjusted as a result of adjusting the feed rate of the web. In this regard, when the eye-mark is registered to a micro-optic structure (e.g., a hologram) on the web, then the overprint is also registered with reference to the micro-optic structure.

As shown in the embodiments of FIGS. 1 through 10, many of the deficiencies of the prior art are remedied by implementing a web-fed flexographic printing process to generate identification devices (e.g., hang-tags, labels, tickets, cards, etc.).

It should be appreciated that the process of FIGS. 9 and 10 may be implemented in a system similar to that shown in FIG. 8. However, it should be appreciated that the process of FIGS. 9 and 10 may be implemented in any web-fed flexographic printing process that employs feedback control to adjust the location of the overprinted layer.

Although exemplary embodiments have been shown and described, it will be clear to those of ordinary skill in the art that a number of changes, modifications, or alterations to the invention as described may be made.

For example, while the controller 845 is shown as a workstation, it should be appreciated that the controller may be a standalone device, which is configured to receive the feedback signal 840 and generate a control signal 850. In this regard, the controller 845 comprises appropriate hardware, software, firmware, or a combination thereof. Thus, the controller 845 may be implemented in software or firmware that is stored in a memory and executed by a suitable instruction-execution system. Alternatively, the controller 845 may be implemented with any or a combination of the following technologies, which are well known in the art: one or more discrete logic circuits having logic gates for implementing logic functions upon data signals, an application specific integrated circuit (ASIC) having appropriate combinational logic gates, one or more programmable gate arrays (PGA), one or more field programmable gate array (FPGA), etc.

Also, while the flowcharts provide example embodiments of processes for fabricating identification devices, it should be appreciated that the order of the blocks in the flowchart may sometimes be performed substantially simultaneously or out of order.

Additionally, while the example embodiments show holograms as being exemplary micro-optic images, it should be appreciated that the micro-optic image may be any nanostructure that is sufficiently difficult to replicate without great expense. In this regard, it should be appreciated that various individual features of the hologram may be replaced by one or more micro-optic structures. Furthermore, it should be appreciated that the entire hologram may be replaced by one or more micro-optic structures.

Also, while the web-fed flexographic printing system 800 is shown with a specific configuration of rollers and stations, it should be appreciated that the rollers and stations may be configured differently, so long as the functionality of the various rollers and stations are preserved.

Moreover, while the particular embodiments show a registered trademark for Officially Licensed Collegiate Product (OLCP)®, it should be appreciated that the predefined pattern may be the mark of any vendor or, alternatively, may be any non-trademarked pattern or text. Also, while specific examples have been shown in the context of hang-tags, it should be appreciated that the identification device may include other items, such as, for example, cards, labels, or tickets, which are amenable to web-fed flexographic printing processes.

Furthermore, while some embodiments show that the eye-mark is located on the holographic sheet, it should be appreciated that the eye-mark may alternatively be located on the substrate. Additionally, it should be appreciated that, in other embodiments, eye-marks may be located on both the holographic sheet and the substrate.

All such changes, modifications, and alterations should therefore be seen as within the scope of the disclosure.

What is claimed is:

1. A web-fed flexographic printing method comprising the steps of:

(A) providing a holographic sheet on a first roller, the holographic sheet comprising a hologram, the holographic sheet further comprising an eye-mark, the eye-mark being located at a fixed location with reference to the hologram;

(B) providing a cardstock substrate on a second roller;

(C) feeding the holographic sheet and the cardstock substrate through a web-fed flexographic printer, the step of feeding the holographic sheet and the substrate comprising the steps of:

(C1) applying an adhesive to the cardstock substrate using an adhesive roller;

(C2) marrying the holographic sheet and the cardstock substrate using the adhesive applied to the cardstock substrate, the marrying of the holographic sheet and the cardstock substrate resulting in a married web;

(C3) detecting the eye-mark;

(C4) generating a feedback signal in response to detecting the eye-mark;

(C5) conveying the feedback signal to a controller, the controller being coupled to a motor, the controller being configured to control a rate of the motor in response to the feedback signal;

(C6) determining whether to adjust the rate of the motor in response to the feedback signal;

(C7) adjusting the rate of the motor in response to determining that the rate of the motor is to be adjusted;

(C8) overprinting ultra-violet (UV) ink onto the holographic sheet, the UV ink being overprinted at a registered location, the registered location being a location that is fixed with reference to the eye-mark;

(C9) curing the UV ink at a UV drying station;

(C10) die cutting the married web at a rotary die.

2. The method of claim 1, further comprising the step of:

printing a serial number on the married web prior to die cutting the married web; and wherein the step of die cutting the married web comprises the step of generating an identification tag having the printed serial number.

* * * * *